US005098073A

United States Patent [19]

Lenz

[11] Patent Number: 5,098,073

[45] Date of Patent: Mar. 24, 1992

[54] TWO-STATION VISE WITH DOUBLE-THREADED SCREW

[75] Inventor: John O. Lenz, Coon Rapids, Minn.

[73] Assignee: Kurt Manufacturing Company, Inc., Minneapolis, Minn.

[21] Appl. No.: 350,568

[22] Filed: May 11, 1989

[51] Int. Cl.[5] ..... B25B 1/20

[52] U.S. Cl. ..... 269/43; 269/136; 269/154; 269/906

[58] Field of Search ..... 269/43, 136, 154, 153, 269/242, 906, 134

[56] References Cited

U.S. PATENT DOCUMENTS 62,584 3/1867 Williams et al. .

2,299,294 10/1942 Barnes ..... 90/60

3,397,880 8/1968 Kuban ..... 269/240

3,861,664 1/1975 Durkee ..... 269/43

4,529,183 7/1985 Krason et al. ..... 269/43

4,934,674 6/1990 Bernstein ..... 269/906

*Primary Examiner*—J. J. Hartman

*Attorney, Agent, or Firm*—Kinney & Lange

[57] ABSTRACT

A machine vise holds two parts against a center mounting block, and has simultaneously moving jaws slidable on a vise body toward opposite sides of the center jaw for clamping. One of the jaws is driven through a torque limiting clutch to the drive screw to provide a preload on one of the parts, after which the clutch releases for final, high pressure tightening.

11 Claims, 3 Drawing Sheets 2
17
18
41
40
25
22
24
21
10
17
32
31
30
11
13
73
72
71
80A
80
5
5
81
75
2

31
80
15
84
81A
81
55
84
81A
15
13
75

15
16
17
40
47
43
41
41A
42
44
51
45
46
10
91
50
11
25
53
23
52
22
20
21
55
24
59
90
58
35
36
3
32
66
62
3
70
31
12
33
61
30
64
65
60
34
37
62
17
72
73
71
84
80
80B
83
75
81B
82
81
85
86
81A
81C 17
16
64
34
18
61
60
52
63
33
62
66
65
17
16

TWO-STATION VISE WITH DOUBLE-THREADED SCREW

BACKGROUND OF THE INVENTION

1. Field of the Invention

The present invention relates to a precision machine vise that clamps two work pieces against oppositely facing surfaces of a fixed block in the center of a vise body and which has a double-threaded screw that simultaneously moves movable jaws toward oppositely-facing surfaces of the fixed block to clamp the work parts, and which includes a preload clutch that provides a preload force on one of the parts prior to final tightening.

2. Description of the Prior Art

Vises that use a center fixed block mounted on a body and movable jaws that move toward the fixed block for holding or clamping parts has been shown in various embodiments in the prior art. U.S. Pat. No. 62,584 shows a vise member that in its preferred embodiment has a center fixed jaw and two movable outer jaws that are forced in toward the center fixed jaw, utilizing either a cam actuator or a screw. The final clamping is made with equal pressure being exerted on the two parts by the cam member or by a screw.

Clamping devices which utilize screws having two threaded sections with opposite hand or lead threads and which actuate movable jaws against a center jaw are also shown in a number of ski clamping vises, such as U.S. Pat. No. 3,861,664. The vise in this patent includes a pair of jaws which float relative to a center jaw or reference member. The movable jaws are simultaneously actuated by a vise screw.

U.S. Pat. No. 2,299,294 shows a work holding device that provides for clamping a plurality of work pieces against members that can be fixed, or which can float for clamping.

U.S. Pat. No. 4,529,183 discloses a machine vise that has a center fixed jaw, and specific, sequential operation of movable jaws. The vise screw that operates the jaws has only one threaded section for one of the jaws. The one threaded section will first close one of the jaws until that jaw engages a work piece, and then the other jaws will be moved to clamp onto a second work piece in sequential operation and without requiring two threaded vise screw sections.

SUMMARY OF THE INVENTION

The present invention relates to a two-station vise that can clamp two parts against oppositely facing surfaces of a block that is fixedly mounted on the vise body, in the region of the center of vise body. The vise has simultaneously movable jaws that move toward and away from opposite surfaces of the center block for clamping. One jaw is driven by a drive section that is drivably connected to a drive member (a screw) through a detent so that after a known preload has been applied by one of the jaws to one of the piece parts, the detent acts like a clutch to permit the one jaw drive section to slip as final high pressure clamping occurs. A screw drive is shown.

A sleeve and holding block are used for adjusting the vise screw to permit changing the spacings between the jaws so that they can be unequal, to clamp two parts of different sizes.

Simultaneous operation of the two jaws by using two threaded sections for moving the jaws greatly enhances rapid and reliable operation and the automatic clutch provides high clamping forces.

DETAILED DESCRIPTION OF THE PREFERRED EMBODIMENTS

Figure 1:
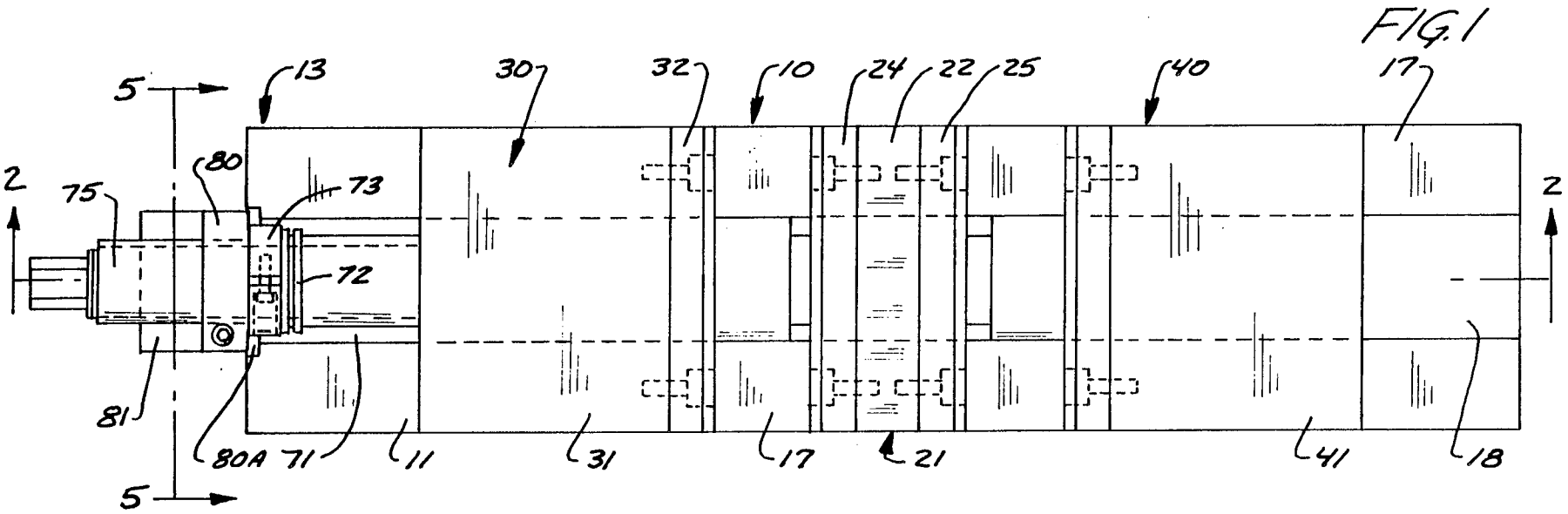
FIG. 1 is a top plan view of a vise made according to the present invention.
Figure 5:
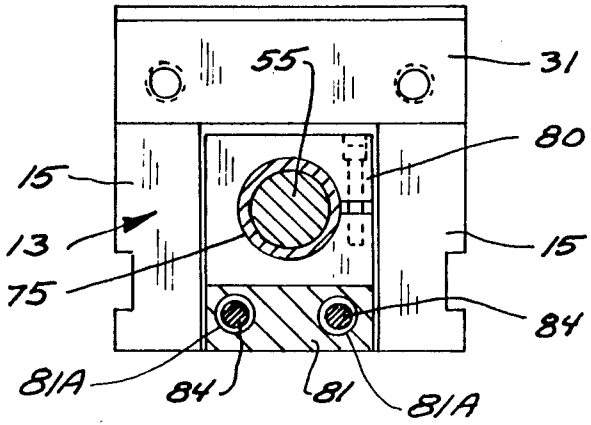
FIG. 5 is a sectional view taken as on line 5—5 in FIG. 2.

A two-station machine vise indicated generally at 10 comprises a vise body 11 that is elongated along a longitudinal central axis, and which includes a base plate 12. Side walls 15 extend upwardly from the base plate 12, and these walls have in-turned upper rail portions 16 which, as is known in machine vise constructions, have upper rail or way surfaces 17. The surfaces 17 are spaced apart to form a central slot 18 that extends along the length of the body. A channel 20 is formed below the rails 16 and between the rails along the length of the body. Movable jaw nuts are slidably retained in channel 20, as will be explained. The actuating or drive end is indicated generally at 13.

The rails 16 support a centrally located fixed jaw assembly indicated generally at 21, which includes a jaw or block 22 that has a key or lug 23 that fits into a recess in the upper surfaces 17 of the rails 16 to hold the block in place. This fixed block 22 can be held in place by suitable cap screws, or similar fasteners.

The fixed block 22 has first and second jaw plates 24 and 25 mounted thereon and these jaw plates can be mounted with suitable cap screws so that they can be turned upside down or end for end for having different jaw arrangements, as desired. The fixed block 22 is approximately midway along the length of the body, and the jaw plates 24 and 25 provide oppositely directed fixed jaw faces.

There are a pair of movable jaws on the vise body 11 that are made in a manner that is known in the art. The mo able jaws can be simultaneously driven toward and away from the fixed block 22 through an actuator, as shown, a vise screw.

At the drive end 13 of the vise body there is a first movable jaw assembly 30, which has a jaw body or block 31 which carries a jaw plate 32, which faces the jaw plate 24. This block 31 is made so that the outer portion of its bottom surface rides along the rail surfaces 17. As shown, the first jaw body 31 has an interior recess 31A into which the head portion 33 of a jaw nut 34 fits.

The head portion 33 has an inclined surface 35 that bears against a part spherical member 36 which, in turn, seats into a receptacle on an interior end surface of the recess 31A in the body 31. The force from the jaw nut 34 acts through this part spherical member 36 to provide a force that is directed partially downwardly against the way surfaces 17, as is well known in the art. A set screw 37 is threaded in the rear wall of the block 31, and bears against the rear surface of the head 33 to retain the parts in assembly and permit the vise nut to be used for moving the block 31 and jaw plate 32 toward and away from the jaw plate 24. The vise body construction and jaw construction is generally as shown in U.S. Pat. No. 3,397,880 to William G. Kuban.

A second movable jaw assembly 40 is generally constructed in the same manner as the first jaw assembly 30, and includes a movable jaw body or block 41, which carries a second movable jaw plate 42 that moves toward and away from the jaw plate 25 mounted on the fixed central block 22. The body or block 41 of the second movable jaw assembly has an interior recess 41A, as shown, which receives a head member 43 of a second jaw nut 44.

The head member 43 of the second jaw nut 44 has an inclined surface 45 which bears against a part spherical member 46 that in turn fits into a receptacle on an end interior surface of recess 41A of the jaw body 41, and provides a force that will, when the jaw nut is actuated, move the second movable jaw toward the fixed plate 25. A set screw 47 is threaded through the rear wall of the jaw body or block 41 and bears against the rear side of the head member 43 to retain the parts together. The second movable jaw 40 has an interior threaded bore 50 that threadably receives a threaded section 51 of a vise screw assembly 52. Vise screw assembly 52 is rotatably mounted relative to the vise body 11, and the second jaw nut moves when the vise screw is rotated to move the jaw toward and away from the fixed jaw assembly 21 and specifically toward and away from the fixed jaw plate 25.

An internal annular or ring type brush 53 is provided ar an inner end of the jaw nut 44 and the brush has bristles that engage the cylindrical surface (unthreaded) of a shaft portion 55 of the vise screw assembly 52, to clean off chips and other debris to prevent interference with the internal threads in the bore 50 and the screw threads 51.

The first movable jaw nut 34 is made to provide for a preload clamping action, and includes a threaded internal bore indicated generally at 58, which is of larger size than the screw shaft portion 55. At the inner end of the jaw nut 34 there is a second ring type annular brush 59 that engages the cylindrical surface of the vise screw shaft 55 and provides a cleaning action to prevent debris and chips from getting into the threaded sections. The vise screw is a jaw drive member, and the thread sections comprise drive sections that engage the threaded bores of the movable jaws, which form drive connections for driving the jaws.

A release clutch assembly indicated generally at 60 is provided for driving the nut 34, and the clutch includes a threaded screw or sleeve section 61 that slidably fits over the shaft portion 55 of the vise screw. The sleeve section 61 has external threads which mate with internal threads of the jaw nut 34. The threads are of opposite hand or lead from the threads 51. The sleeve section 61 is normally rotationally driven with respect to the shaft portion 55 of the vise screw assembly through the use of a release detent means shown at 62 comprising a spring-loaded detent member 63. As shown, in FIGS. 2 and 3 the detent member 63 is a roller that fits partially into an axially extending recess 65 in the outer surface of vise screw shaft 55, and lies partially in a recess indicated at 66 on the interior bore of the threaded sleeve section 61 (see FIG. 3). A plurality or preload-drive springs 64 are placed in radial bores in the shaft portion 55, and provide a spring load on the roller 63 radially outwardly to urge the detent member or roller 63 into the recess 66 in the threaded sleeve section 61. The recess 65 in the shaft portion is sufficiently deep to permit the detent roller 63 to retract into the shaft portion 55 so it will retract from recess 66 in the sleeve section 61. The retraction of the roller out of the recess 66 thus disengages the drive from the vise shaft to the movable jaw assembly 30. If the recess 65 was made longer, a longer roller and four springs 64 can be used. A detent ball also can be used.

A snap ring 70 is provided on the shaft section 55 to prevent the sleeve section 61 from moving toward the thread section 51. A clutch sleeve 71 is slidably mounted over the shaft section 55, and extends from the opposite end of the threaded sleeve 61 from snap ring 70 toward the end 13 of the vise body. This is the actuation end of the vise. The outer end of the clutch sleeve 71 bears against a thrust bearing 72 that encircles the shaft portion 55 of the vise screw assembly, and the thrust washer in turn bears against a split collar 73 that can be clamped onto an annular recess in the shaft portion 55. The split collar 73 is fixed in position axially on the vise screw shaft and positively fixes the axial position of the thrust bearing 72 on the vise screw assembly and the split collar thus holds the threaded sleeve section 61 properly axially located on the shaft section 55 of the vise screw assembly through the thrust bearing 72 and sleeve 71.

A sleeve 75 is mounted over shaft section 55 to the exterior of the split collar 73. A split clamp holding block 80 has a bore that fits over the sleeve 75 and is positioned to the outer side of a thrust washer 80B that bears on the split collar 73. When the clamp portion of the holding block is tightened down, the sleeve 75 is clamped to the shaft portion 55.

The holding block 80 has an integral coupling lug 81, that extends downwardly from the vise screw assembly and is positioned on the outside of the vise body. The lug has a lateral width sufficient to have a pair of openings that receive cap screws 84. Counter bores 81A and 81B are provided at opposite ends of each of the openings for cap screws 84. The counter bores 81A and 81B receive spring sets 82 and 83, each comprising a plurality of spring washers (Belleville springs). The cap screws 84 pass through the spring washers. Cap screws 84 are threaded into the base 12 of the vise body, and they are shouldered so that they form studs that are tightly held in place. The spring washer sets 82 and 83 will permit the member 81 to move slightly under spring load in opposite axial directions of the vise screw assembly. One of the spring washer sets for each cap screw 84 bears against the head of that cap screw, and the other spring washer set 83 bears against a spacer ring 83A which in turn bears on a surface of the end 13 of the base 12 and can slide into counter bore 81B.

The sleeve 75 is retained from sliding off the shaft section 55 with a suitable end snap ring 85, and a handle drive end 86 is formed on the end of the vise screw shaft 55 for accommodating a drive handle of conventional design (not shown).

The spring washer sets 82 and 83 act on opposite sides of an internal ring 81C formed by the counter bores 81A and 81B and tend to center the holding block 80 in a spring loaded centered position when the movable jaws are not under clamping load the holding block is spaced from surfaces of the end wall 13 in this position (shown to form an inward abutment surface 89). The holding block recess 80A is in a position so that the holding block and the vise screw assembly which is retained by the holding block can move or yield axially (in or out) to provide a spring preload on clamped parts as one or the other of the spring washer sets compresses and before the spring washer sets 82 or 83, respectively, on each of the cap screws 84, compresses fully. Recess 80A provided in the end of the vise body permits the holding block 80 to move inwardly as spring set 83 compresses. The holding block 80 can move outwardly if loads cause spring set 82 to compress. The holding block 80 reacts initial clamping loads from the vise screw, which is axially movable and held axially only by holding block 80 back to the vise body.

Figure 2:
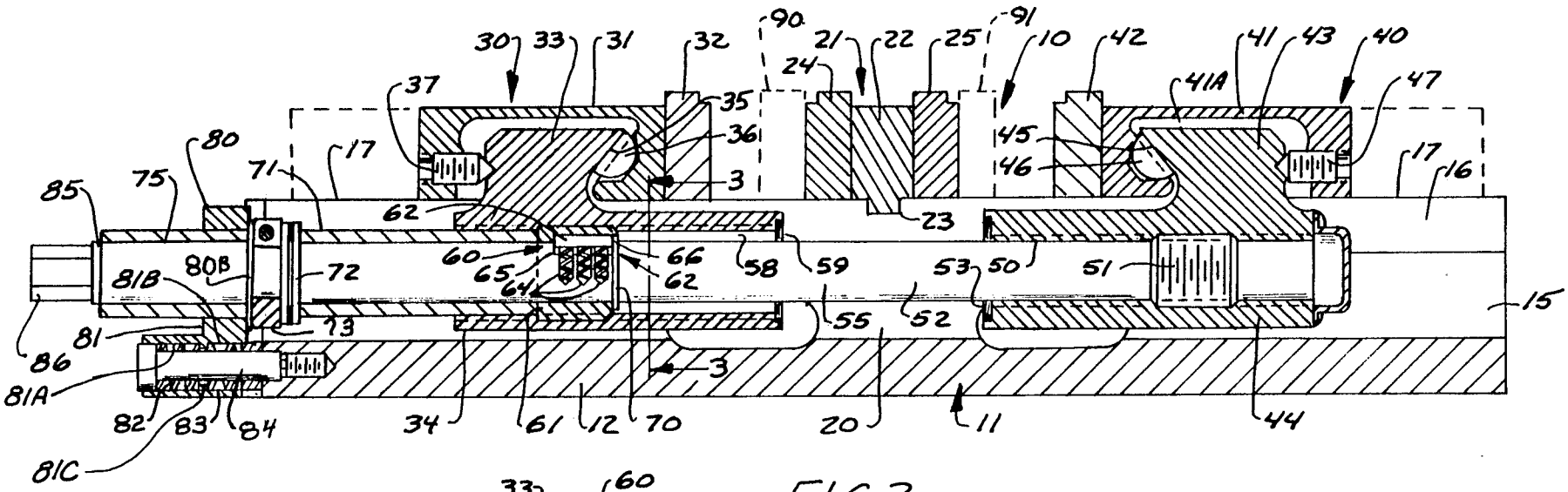
FIG. 2 is a sectional view taken as on line 2—2 in FIG. 1.
Figure 3:
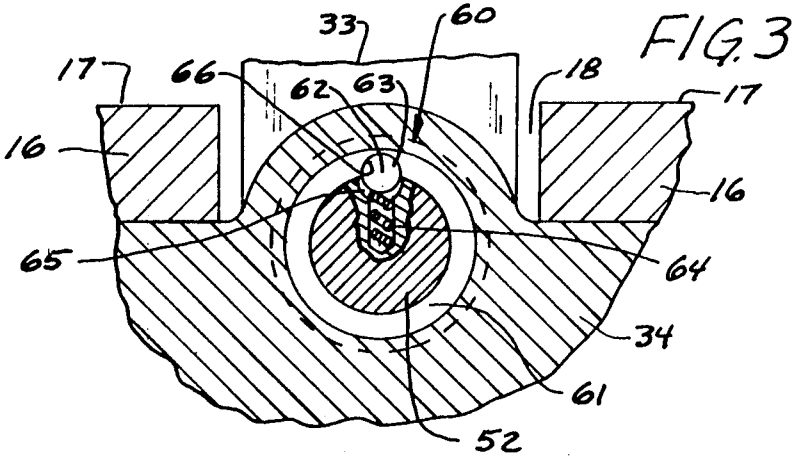
FIG. 3 is a sectional view taken as on line 3—3 in FIG. 2.
Figure 4:
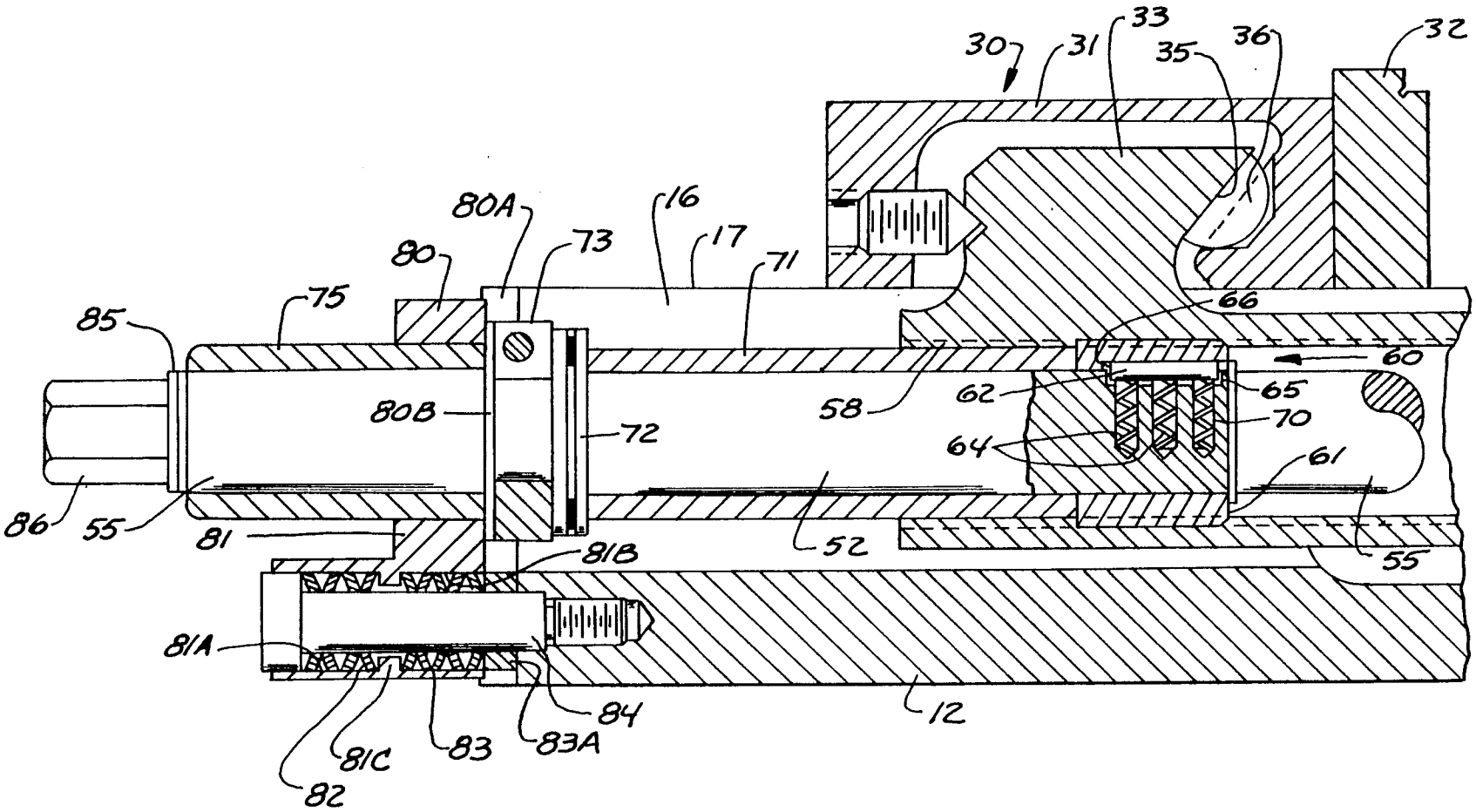
FIG. 4 is a fragmentary enlarged sectional view of a drivable connector between a vise screw and one movable jaw.

When the vise screw assembly is operated to open the movable jaws, as shown in FIG. 2, piece parts 90 and 91 can be put into the jaw assemblies, and then the vise screw can be rotated and the jaws will simultaneously move toward the central block 22. It should be noted that the threaded sleeve section 61 and the threaded screw section 51 of the vise screw have opposite hand or lead threads, so that upon rotation of the vise screw assembly in one direction, the movable jaws will simultaneously move toward the central block or away from the central block, depending on the direction of rotation.

As can be seen in FIG. 2, the vise screw assembly 52 mounts the movable jaw 30 and the movable jaw 40, but both jaws are free to move relative to the vise body, and the screw assembly 52 is only restrained relative to the vise body through the holding block 80 as positioned on the sleeve 75. The holding block 80, as stated is permitted to yieldably move in axial direction of the screw by compressing the spring set 82 or the spring set 83, depending on the forces acting on the respective movable jaws 30 and 40.

When the movable jaws are moved to tighten against the work pieces 90 and 91, the position of the respective jaws relative to the center block 22 can be selected by positioning the holding block 80 on the sleeve 25 to shift the vise screw assembly 52 and thus both jaws 30 and 40 in one direction relative to the center block 22 a small amount, but a sufficient amount so, that one or the other of the jaws 32 or 42 will contact a work piece first to preload that work piece. This is accomplished by adjusting the position of the holding block 80 to a desired location along sleeve 75. The holding block 80 is a split collar type block that can be loosened by loosening the clamping cap screw on the holding collar and sliding the sleeve 75 axially, inwardly, which will for example, simultaneously move jaw assembly 30 closer to the block 22 and jaw assembly 40 farther from the block 22. The holding block 80 is then clamped back onto sleeve 75 to provide for a positive positioning of the sleeve 75 and the vise screw assembly 52. Then by threading the screw member 51, the jaws plates 32 and 42 both move toward block 22, but if the relative positions of the two jaw plates 32 and 42 with respect to jaw plates 35 and 45 are made different, one of the jaw plates will contact its respective work piece first. The spacings between the jaw plates 32 and 42, with respect to their associated jaw plates 35 and 45 can be made to be substantially equal if desired.

In any event, when one of the jaw plates 32 or 42 contacts its respective work piece the vise screw will tend to shift axially because both threaded sections of the vise screw are driving the respective jaws and one jaw is stopped on the work piece before the other jaw engages its work piece. The preload force determined by the spring sets 82 and 83, which compresses to permit the vise screw to move axially until both jaws contact the respective work pieces 90 and 91. The clutch assembly 60 permits driving of screw sleeve section 61 until thread loads resisting rotation of sleeve section 61 causes the roller or detent 62 to retract sufficiently into the recess 65 in the shaft section 55 so that the detent will release and the sleeve section 61 will no longer rotate Then the screw section 51 will provide an opposing clamping force on jaw plate 32 to react loads caused by continued threading of section 51 relative to block 44, causing forces to be applied to jaw plate 42 acting through the shaft section 55, the collar 73, the thrust bearing 72, the clutch sleeve 71 and the threads on the threaded sleeve section 61 (which is no longer rotating) because threaded section 51 generates clamping force as the screw turns and this clamping force is reacted through collar 73, sleeve 71, and the threads on threaded sleeve section 61 back to the threaded block 33 to react forces on the jaw plate 32. The parts then can be tightened down type A16 again. Upon reversal, an opposing action will occur, and the two threaded sections 51 and 61 will simultaneously drive the movable jaws away from the central jaw plate.

In this manner, the great advantage of simultaneous movement of the jaws is achieved, preloading of the members can be also achieved to permit positioning either of the parts under a preload, and final clamping can occur while the one drive section slips relative to the jaw drive member (a vise screw shaft, as shown) while the drive member continues to apply high clamping force to the jaws.

Although the present invention has been described with reference to preferred embodiments, workers skilled in the art will recognize that changes may be made in form and detail without departing from the spirit and scope of the invention.

What is claimed is:

1. A vise assembly comprising a body, said body having opposite ends, and means for guiding movable vise jaws thereon;

a fixed vise jaw mounted on said body between said opposite ends, said fixed jaw having oppositely facing fixed jaw surfaces;

a pair of movable jaws mounted on said body, each of said movable jaws having a jaw surface facing one of the fixed jaw surfaces, and each of said movable jaws being movable toward and away from the fixed jaw, each of said movable jaws including an internal threaded bore, said bores being in alignment with each other and having opposite hand threads;

a vise screw having at least two spaced threaded sections of opposite direction lead threadably mating with the internal threaded bores of the movable jaws, respectively, whereby upon rotation of the vise screw about a central longitudinal axis the movable jaws will simultaneously move toward the fixed jaw when the vise screw is rotated in a first direction, and move away from the fixed jaw when the vise screw is rotated in a second direction; and clutch means for drivably coupling one of the threaded sections to the vise screw, whereby when a load on the movable jaw being driven by the one threaded section exceeds a certain level, the clutch means releases the drive coupling to permit the one threaded section to stop rotating with the screw, while being retained from movement in direction of the longitudinal axis of the screw while the other threaded portion can be rotated by rotating the screw relative to the one threaded section for clamping of both of the movable jaws against the fixed jaw.

2. The vise assembly as specified in claim 1 and means for limiting axial movement of the one threaded section relative to other portions of the vise screw.

3. The vise assembly as specified in claim 1 wherein said clutch means comprises a spring loaded detent mounted on a portion of the vise screw and engaging a portion of said one threaded section.

4. The vise assembly as specified in claim 1 wherein said one threaded section comprises a sleeve with a central bore, said vise screw having a shaft portion passing through said central bore, and wherein said clutch means comprises a detent operable between said vise screw shaft portion and a surface defining the bore of said sleeve section.

5. The vise assembly as specified in claim 1 and means for adjustably positioning the vise screw in an axial direction of the vise screw relative to the vise body.

6. The vise assembly as specified in claim 5 wherein the means for adjustably positioning comprises stop block means releasably clamped relative to the vise screw for reacting force from the vise screw to the vise body, said clamp blade being positionable at different locations axially along the vise screw.

7. A vise assembly comprising a vise body, said vise body having opposite ends, and means for guiding movable vise jaws thereon;

a fixed vise jaw mounted on said body between said opposite ends, said fixed jaw having oppositely facing fixed jaw surfaces;

a pair of movable jaws slidably mounted on said body, each of said movable jaws having a jaw surface facing one of the fixed jaw surfaces, and each of said movable jaws being movable toward and away from the fixed jaw, each of said movable jaws having a drive connection;

a drive member having at least two spaced drive sections to drivably mate with the drive connections of the movable jaws, respectively, whereby upon operation of the drive member in each of two opposite directions of operation the movable jaws will simultaneously move toward the fixed jaw and away from the fixed jaw, respectively; and clutch means for releasably drivably coupling one of the drive sections to the drive member, whereby when a load on the one movable jaw being driven by the one drive section exceeds a selected force level, the clutch means releases the driving of the one jaw but prevents movement of the one jaw relative to the drive member in direction away from the fixed vise jaw and the other drive section will continue to apply force to move the movable jaws together in direction toward the fixed jaw as the drive member is continued to be operated.

8. The vise assembly specified in claim 7 wherein said drive member comprises a rotatable vise screw having a central longitudinal axis, and the drive sections comprise threaded sections, which threadably contact to the movable jaws, the one drive section comprises a sleeve with a central bore, said vise screw having a shaft portion passing through said central bore, and wherein said clutch means comprises a detent operable between said vise screw shaft portion and the surface defining the bore of said sleeve section the detent being mounted to retract driving engagement with the sleeve to release rotational driving forces between the vise screw shaft and the sleeve when drive torque exceeds a selected level.

9. A vise assembly comprising a body, aid body having opposite ends, and means for guiding movable vise jaws thereon;

a fixed vise jaw fixedly mounted on said body;

a pair of movable jaws mounted on said body, each of said movable jaws having a jaw surface facing opposite sides of the fixed jaw, and each of said movable jaws being movable toward and away from the fixed jaw, a vise screw having at least two spaced threaded sections of opposite direction lead threads to threadably mate with threaded members of the movable jaws, whereby upon rotation of the vise screw the movable jaws will simultaneously be driven by the threaded sections to move toward the fixed jaw when the vise screw is rotated in a first direction, and away from the fixed jaw when the vise screw is rotated in a second direction; and clutch means for drivably coupling one of the threaded sections to the vise screw, said clutch means releasing the drive coupling of the one threaded section at a desired torque level on the vise screw to permit the vise screw to be rotated without driving the one threaded section.

10. The vise assembly of claim 9, and means for mounting the vise screw for limited axial movement relative to the vise body.

11. The vise assembly of claim 10 and bias means to urge the means for mounting the vise screw to a reference position.

* * * * *

UNITED STATES PATENT AND TRADEMARK OFFICE

CERTIFICATE OF CORRECTION

PATENT NO. : 5,098,073

DATED : March 24, 1992

INVENTOR(S) : JOHN O. LINZ

It is certified that error appears in the above-identified patent and that said Letters Patent is hereby corrected as shown below:

Column 8, line 10, delete "contact", insert "connect".

Column 8, line 21, delete "aid" , insert "said".

Signed and Sealed this

Fifth Day of October, 1993

Bruce Lehman

*Attest:*

BRUCE LEHMAN

*Attesting Officer*

*Commissioner of Patents and Trademarks*